United States Patent [19]

Makino

[11] 4,160,897

[45] Jul. 10, 1979

[54] CERAMIC HEATING ELEMENT WITH RESTIVITY ADJUSTED TO A CERTAIN VALUE

[75] Inventor: Yoichi Makino, Nagoya, Japan

[73] Assignee: NGK Spark Plug Co., Ltd., Nagoya, Japan

[21] Appl. No.: 915,099

[22] Filed: Jun. 13, 1978

[30] Foreign Application Priority Data

Jun. 14, 1977 [JP] Japan ..... 52-69450

[51] Int. Cl.[2] ..... H05B 3/16

[52] U.S. Cl. ..... 219/543; 219/464; 219/552; 338/288; 338/297; 338/300

[58] Field of Search ..... 219/463, 464, 542, 543, 219/552; 338/288, 289, 294, 295, 297, 299, 300, 309

[56] References Cited

U.S. PATENT DOCUMENTS

| | | | |
|---|---|---|---|
| 1,563,731 | 12/1925 | Ducas | 338/297 X |
| 2,703,833 | 3/1955 | Vanvor | 219/297 X |
| 2,710,900 | 6/1955 | Linder | 219/543 |
| 2,744,987 | 5/1956 | Marvin | 338/297 |
| 2,915,613 | 12/1959 | Norton | 219/543 |
| 3,283,285 | 11/1966 | Zuk | 338/299 |
| 3,496,336 | 2/1970 | Hingorany et al. | 219/464 |
| 3,881,162 | 4/1975 | Caddock | 338/288 |
| 3,912,905 | 10/1975 | Giler | 219/464 |

*Primary Examiner*—Volodymyr Y. Mayewsky
*Attorney, Agent, or Firm*—Sughrue, Rothwell, Mion, Zinn and Macpeak

[57] ABSTRACT

In a ceramic heating element comprising a ceramic substrate having on a surface thereof a resistor pattern of an electrically conductive material and a ceramic electrically insulating layer disposed on the surface of the ceramic substrate with the resistor pattern thereon, the improvement wherein the ceramic electrically insulating layer includes an opening, the resistor pattern exposed by the opening in the ceramic electrically insulating layer being electrically shorted and/or an electrical short-circuiting path previously provided in the resistor pattern being cut whereby the resistivity of the resistor pattern is adjusted to within a particular range, and a heat resistant electrically insulating coating filling the opening in the ceramic electrically insulating layer.

9 Claims, 3 Drawing Figures

FIG 1
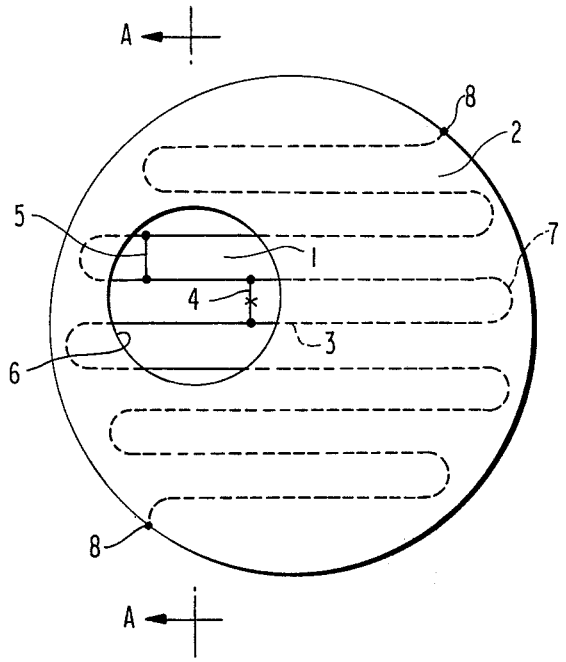
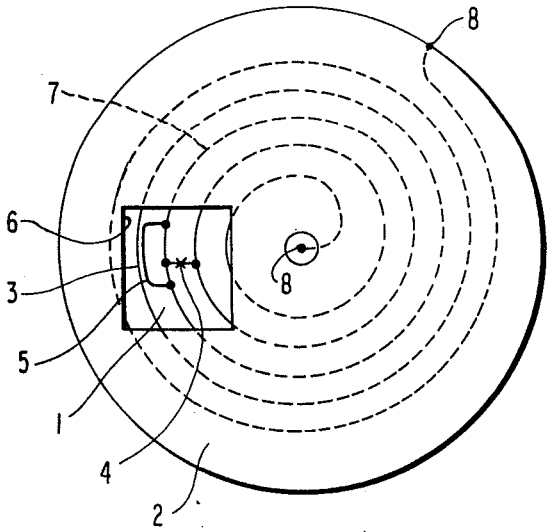
FIG 2
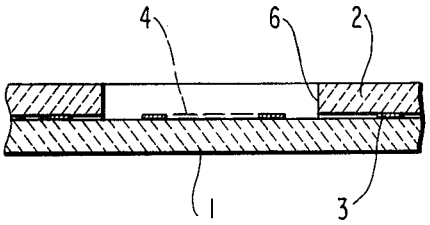
FIG 3

CERAMIC HEATING ELEMENT WITH RESTIVITY ADJUSTED TO A CERTAIN VALUE

BACKGROUND OF THE INVENTION

1. Field of the Invention

This invention relates to a ceramic heating element comprising a ceramic substrate having on a surface thereof a resistor pattern made of an inorganic electrically conductive material and a ceramic electrically insulating layer disposed on the surface of the ceramic substrate having the resistor pattern thereon. More particularly, it relates to a ceramic heating element whose resistivity can be adjusted to a certain value.

2. Description of the Prior Art

A ceramic heating element comprising a ceramic substrate having formed thereon a resistor pattern made of an inorganic electrically conductive material and coated with a ceramic electrically insulating layer is conventionally known. Such a heating element is produced by first coating or metalizing a resistive paste that contains an inorganic electrically conductive material onto a ceramic green sheet, superimposing another ceramic green sheet on the first ceramic green sheet to form an integral element, and calcining the integral element. However, in this conventional method, the resistivity of the resulting resistor varies so greatly, depending on factors such as the metalizing width and thickness as well as the calcining conditions, that it is extremely difficult to obtain a desired constant resistivity value or resistivity within a certain range, and therefore, a ceramic heating element of high quality cannot be produced efficiently on a commercial scale.

British Pat. No. 1,236,580 discloses a thin film electrical-resistor comprising an electrically insulating thin synthetic resin film as a substrate. Of course, the procedures described therein cannot be used for producing ceramic heating elements because of the nature of the synthetic resin thin film used as a substrate.

SUMMARY OF THE INVENTION

Therefore, an object of this invention is to solve the problems of conventional techniques for producing ceramic heating elements and to provide a ceramic heating element whose resistivity is adjusted to a certain value or range.

The ceramic heating element of this invention comprises a calcined product of a resistor pattern made of an inorganic electrically conductive material that is formed between a ceramic substrate and a ceramic electrically insulating layer and is produced by forming an opening in the electrically insulating ceramic layer in advance, and cutting a previously provided short-circuiting path in the resistor pattern which is exposed in the opening and/or providing an additional short-circuiting path in the resistor pattern exposed in the opening, and filling the opening with a coating of a heat resistant electrically insulating material.

BRIEF DESCRIPTION OF THE DRAWINGS

FIG. 1 is a schematic representation of one embodiment of this invention, illustrated in Example 1 given hereinafter. The Figure is a plan view showing how an opening is formed in a ceramic heating element according to this invention.

FIG. 2 is a schematic representation of another embodiment of this invention. The Figure is also a plan view showing the configuration of an opening.

FIG. 3 is a cross-sectional view of the opening of FIG. 1 taken along lines A—A'.

In these figures, reference numeral 1 is a ceramic substrate, 2 is a ceramic electrically insulating layer, 3 is a resistor pattern, 4 is a short-circuiting path cut, 5 is a short-circuiting path previously provided, 6 is an opening in the ceramic electrically insulating layer filled with a heat resistant electrically insulating material, 7 is a reserve circuit, and 8 is a terminal.

DETAILED DESCRIPTION OF THE INVENTION

The "ceramic heating element" as described herein employs as the substrate thereof a heat resistant, heat conductive and air-impermeable ceramic such as alumina, beryllia, mullite, zircon, cordierite, etc. A ceramic green sheet as the substrate is conventionally prepared by blending the ceramic materials described above with an organic binder, and rolling the blend or flow casting the blend on a planar support, followed by drying with heat, e.g., at about 100° to 260° C.

A resistor is conventionally formed on such a green sheet by metalizing (or coating) a resistive paste that contains electrically conductive materials, e.g., having a resistivity of less than about 10 Ω.cm or less than about 100 mΩ per square, such as platinum (Pt), palladium (Pd), molybdenum (Mo), tungsten (W), etc. to provide a given pattern (e.g., a serpentine pattern, a helical pattern or any other wiring pattern mode). An electrically insulating layer (of a composition which can be the same as or different than that of the substrate) appropriately provided with an opening is then superimposed on the substrate, and the resulting laminate is calcined, e.g., at about 1400° to 1800° C., preferably 1550° to 1650° C., in a non-oxidizing atmosphere. Suitable non-oxidizing atmospheres which can be used include an atmosphere of hydrogen, nitrogen, mixtures thereof or under vacuum, e.g., 1 Torr or less.

However, the resistivity values of ceramic heating elements produced according to the conventional method described above are scattered with a deviation which is generally more than 10%. The purpose of this invention is to eliminate this scattering or deviation of the resistivity values involved in conventional ceramic heating elements. According to this invention, an opening is formed in the electrically insulating layer to be superimposed on the substrate, and a short-circuiting path, that has been previously provided in the resistor pattern, and which is exposed in the opening is cut, or an additional short-circuiting path formed of a paste that contains an electrically conductive material, e.g., a powder of tungsten, molybdenum, gold, nickel, copper, etc. is provided in the resistor pattern exposed in the opening, and thereafter, the electrically insulating layer is sealed by filling the opening with an electrically insulating paste having a melting point equal to or preferably lower than that of the electrically insulating layer. Short-circuiting paths can be provided in a desired manner depending on the need, but for the purpose of finely adjusting the resistivity, they only need be provided within a single linear section or between more than one adjacent wiring sections of the resistor pattern. In this manner, the maximum deviation of the resistivity can be controlled to within about ±5% of a particular desired value.

Any known heat resistant electrically insulating material, e.g., having a resistivity of more than about $10^{12}$ Ω·cm, such as a ceramic material, a glassy material, a glaze or a heat resistant cement may be used as the sealant depending upon the use of the heating element, the heat resistance required therefor, and other conditions. A suitable ceramic material which can be used as a sealant is, for example, alumina with 2% by weight of an equal mixture of $SiO_2$ and MgO. An example of a sealant material suitable for use as a sealant is an electrically insulating paste, e.g., a glaze material with a low melting point, which comprises, by weight, 73.7% of PbO, 11.6% of ZnO, 10.9% of $B_2O_3$, 1.5% of BaO and 2.3% of $SiO_2$, which has a melting point of 370° C., and which can be calcined at about 400° to about 450° C. An example of a sealant material suitable for use at elevated temperature is an electrically insulating paste, e.g., glaze material with a high melting point, which comprises, by weight, 75% of $SiO_2$, 4% of $B_2O_3$, 2% of $Al_2O_3$, 2% of CaO, 13% of $Na_2O$, and 4% of $K_2O$, which has a melting point of 950° C. and which can be calcined at about 1000° C. A heating element that uses this electrically insulating paste can withstand a temperature up to about 800° C. For use at higher temperatures, the sealant may be the same material as that of the ceramic substrate. For use at lower temperature, the sealant may be a heat resistant alumina cement or the like. If a heat resistant cement or the like is used as the sealant material for the sealing layer, calcination is not necessarily required in the sealing treatment.

The material for forming the above-described short-circuiting path may be the same as the material of the above-described resistor to be metalized, e.g., after printing, on the substrate or the material may be made of electrically conductive materials such as gold (Au), copper (Cu), nickel (Ni), etc. that are employed conventionally for producing thick films. The providing of a short-circuiting layer using a short-circuiting paste that contains these electrically conductive materials is followed by the above-described sealing treatment. The short-circuiting layer may be calcined before or after the sealing treatment, or simultaneously with the calcination of the sealing electrically insulating coating. If the short-circuiting path is made of an electrically conductive paint that can be processed at room temperature (e.g., about 20° to 25° C.) or lower temperature (e.g., about 5° to 15° C.), the above-described heat resistant cement is preferably used as the sealent to provide a heating element that can be advantageously used at relatively low temperatures.

The position and size of the above-described opening that is formed in the electrically insulating layer prior to the calcination of the ceramic heating element is appropriately selected depending upon the need. The planar configuration and size of the opening may be appropriately selected depending upon what area is to be cut.

The short-circuiting path may be cut using any conventional method, for example, using a diamond whetstone, honing or laser.

According to this invention, fine adjustment of the resistivity, e.g., to within ±5%, is achieved in the following manner. The entire length of the pattern of the resistor circuit of a calcined heating element is predetermined by the metalization design. If the measured resistivity of the calcined heating element is higher than the upper limit of the predetermined resistivity range, the length of shorting circuit required is calculated and the shorting circuit is formed at an appropriate point in the pattern. Conversely, if the measured resistivity is less than the lower limit of the predetermined resistivity range, a plus error, e.g., adjustment toward the plus side, is obtained by cutting a short-circuitng path 4 of a reserve circuit 7 that statistically provides a maximum resistivity deviation. According to this invention, the plus error thus obtained can be easily adjusted to the desired value by the method for providing a short-circuit as described above. Hence, this invention permits complete adjustment of the resistivity in a heating element whether it has a plus error or a minus error in resistivity.

As an effective development of this invention, an opening that covers a maximum range of possible errors as calculated on the basis of statistical data can be limitatively disposed within a given area of the electrically insulating layer. Calcination in a non-oxidizing atmosphere provides a heating element wherein the resistor pattern exposed in the opening is calcined without substantial difference from that portion of the pattern coated with the insulating layer.

The pattern of the resistor circuit useful in the practice of this invention may be a serpentine form, a serpentine form with rectangular ridges, a spiral form or a combination of these forms. All other known patterns can be used. However, to minimize the area of the opening and to provide within the same opening both the above-described shorting site and the site for cutting a short-circuiting path, it is desirable for the two sites to be positioned on adjacent wiring sections of the resistor pattern.

This invention is now illustrated in greater detail by reference to the following example. Unless otherwise indicated, all percentages are by weight.

EXAMPLE

A mixture of alumina and 1% of each of magnesia and calcia and 2% of silica (as a flux) was wet ground with a ball mill for about 70 hours, the water was removed and the mixture was dried to obtain a powder. The powder was mixed with 3% of isobutyl methacrylate, 1% of nitrocellulose and 0.5% of dioctyl phthalate in a ball mill in the presence of a solvent comprising trichloroethylene and n-butanol to provide a fluid slurry. The slurry was defoamed under reduced pressure, flow cast on a planar support, slowly heated to evaporate the solvent so as to provide a green sheet having a thickness of 1 mm. The green sheet thus obtained was cut into a circular form as shown in FIG. 1. A layer in the form of a serpentine pattern, as shown in FIG. 1, of an electrically conductive resistor paste containing metallic molybdenum (Mo) was metalized on the green sheet to provide an average layer width of 50 μ. The resistor layer included a reserve circuit 7 and a short-circuiting path 5.

A green sheet of the same composition as that of the substrate green sheet and having an opening 6 was coated onto the metalized pattern of the resistor, and pressed between plates heated at about 130° C. The above-described electrically conductive resistor paste was coated onto a terminal 8, and the composite sheet was calcined at 1650° C. in a hydrogen atmosphere to provide a ceramic heating element. The resistor layer of the short-circuiting path 4 exposed in the opening of the heating element thus obtained was cut with a diamond whetstone to provide a plus error corresponding to the resistivity of the reserve circuit (Example 1-a). A short-circuiting path 5 made of an electrically conductive paste that contained gold (Au) was provided in the resistor circuit obtained in Example 1-a to thereby reduce the plus error (Example 1-b). The opening was thereafter filled with a coating of an electrically insulating paste having a composition of 73.7% of PbO, 11.6% of ZnO, 10.9% of $B_2O_3$, 1.5% of BaO and 2.3% of $SiO_2$, and the heating element was calcined at about 500° C. in a reducing atmosphere of hydrogen. Table 1 shows the results of the fine adjustment of the resistivity effected above.

Table 1

| | Resistivity | | |
|---|---|---|---|
| Example | Heating Element Before Adjustment | Short-Circuiting Path Cut | Short-Circuiting Path Cut, Followed by Formation of Short-Circuit |
| 1a | 19.09 | 20.03 | — |
| 1b | 19.30 | — | 19.76 |

As described hereinbefore, this invention provides the ability to accurately adjust the resistivity of a ceramic laminate heating element that has been considered difficult in the prior art. It expands the field of industrial application of ceramic laminate heating elements that have been subject to various limitations due to large deviations in the resistivity. The present invention can also provide even higher accuracy in resistivity by combining the methods of fine adjustment described in Example 1-a and 1-b. In this connection, it should be understood that the ceramic substrate to be used in this invention can not only be flat but can also be curved or cylindrical or have any other form. This invention cannot only be applied to the production of a ceramic heating element having a single layer resistor pattern but also the present invention may be applied to the production of a ceramic heating element having a multi-layered resistor pattern by appropriately arranging the openings and resistor patterns.

While the invention has been described in detail and with reference to specific embodiments thereof, it will be apparent to one skilled in the art that various changes and modifications can be made therein without departing from the spirit and scope thereof.

What is claimed is:

1. In a ceramic heating element comprising a ceramic substrate having on a surface thereof a resistor pattern of an electrically conductive material and a ceramic electrically insulating layer disposed on the surface of the ceramic substrate with the resistor pattern thereon, the improvement wherein the ceramic electrically insulating layer includes an opening through which a part of the resistor pattern is exposed, the effective length of the resistor pattern being changed through said opening, whereby the resistivity of the resistor pattern is adjusted to within a particular range, and a heat resistant electrically insulating coating filling the opening in the ceramic electrically insulating layer.

2. The ceramic heating element according to claim 1, wherein said heat resistant electrically insulating coating is a coating of a ceramic material, a glassy material, a glaze or a heat resistant cement.

3. The ceramic heating element according to claim 8, wherein said electrical short-circuiting path electrically shorting part of said resistor pattern exposed in said opening is a metalized surface produced through baking or by printing an electrically conductive paint.

4. The ceramic heating element according to claim 1, wherein part of said resistor pattern exposed in the opening includes an electrical short-circuiting path forming a reserve circuit corresponding to the maximum minus error of resistivity.

5. The ceramic heating element according to claim 1, wherein part of said resistor pattern exposed in the opening is electrically shorted and a previously provided electrical short-circuiting path exposed in the opening is cut.

6. The ceramic heating element according to claim 3, wherein part of said resistor pattern exposed in the opening is electrically shorted and the previously provided electrical short-circuiting path exposed in the opening is cut.

7. The ceramic heating element according to claim 4, wherein part of said resistor pattern exposed in the opening is electrically shorted and a previously provided electrical short-circuiting path exposed in the opening is cut.

8. The ceramic heating element according to claim 1, wherein the resistor pattern exposed through said opening is electrically shorted to change the effective length of the resistor pattern.

9. The ceramic heating element according to claim 1, wherein a previously existing electrical short-circuiting path in the resistor pattern exposed through said opening is cut in order to change the effective length of the resistor pattern.

* * * * *